US009249634B1

(12) United States Patent
Streety et al.

(10) Patent No.: US 9,249,634 B1
(45) Date of Patent: Feb. 2, 2016

(54) METHOD FOR LIFTING A TUBULAR FROM A WELL

(71) Applicant: TRIPLE J TECHNOLOGIES, LLC, Tomball, TX (US)

(72) Inventors: Jimmy Duane Streety, Bacliff, TX (US); James Otis Miller, Tomball, TX (US); Jack Allen, Porter, TX (US)

(73) Assignee: TRIPLE J TECHNOLOGIES, LLC, Tomball, TX (US)

( * ) Notice: Subject to any disclaimer, the term of this patent is extended or adjusted under 35 U.S.C. 154(b) by 417 days.

(21) Appl. No.: 13/776,230

(22) Filed: Feb. 25, 2013

Related U.S. Application Data

(60) Provisional application No. 61/603,206, filed on Feb. 24, 2012.

(51) Int. Cl.
*E21B 19/00* (2006.01)
*E21B 19/06* (2006.01)
*E21B 19/02* (2006.01)

(52) U.S. Cl.
CPC ..... *E21B 19/00* (2013.01); *E21B 19/02* (2013.01); *E21B 19/06* (2013.01)

(58) Field of Classification Search
None
See application file for complete search history.

(56) References Cited

U.S. PATENT DOCUMENTS

| | | | | |
|---|---|---|---|---|
| 7,021,381 | B1 * | 4/2006 | Remedies et al. | 166/298 |
| 2004/0262015 | A1 * | 12/2004 | Mazzella et al. | 166/383 |
| 2010/0270033 | A1 * | 10/2010 | Angelle et al. | 166/380 |

* cited by examiner

*Primary Examiner* — Jennifer H Gay
*Assistant Examiner* — Caroline Butcher
(74) *Attorney, Agent, or Firm* — Buskop Law Group, PC; Wendy Buskop

(57) ABSTRACT

A method for removing a tubular from a wellbore can include repeatedly and sequentially using an upper gripping member of an upper section and a lower gripping member of a lower section to hydraulically grip the tubular, while repeatedly and sequentially extending and retracting the upper section relative to the lower section to raise the tubular from the wellbore to a predetermined height. At least one lifting hole can be formed in the tubular, and a lifting member can be installed in each lifting hole. A hoist can be connected with each lifting member. The tubular can be cut using a saw and removed from the wellbore using the hoist.

14 Claims, 8 Drawing Sheets

METHOD FOR LIFTING A TUBULAR FROM A WELL

CROSS REFERENCE TO RELATED APPLICATIONS

The current application claims priority to and the benefit of U.S. Provisional Patent Application Ser. No. 61/603,206 filed on Feb. 24, 2012, entitled "METHOD FOR LIFTING A TUBULAR FROM A WELL." This Reference is hereby incorporated in its entirety.

FIELD

The present embodiments generally relate to a method for lifting a tubular from a well.

BACKGROUND

A need exists for a method for lifting a casting from a well that requires fewer personnel.

A need exists for a method for lifting a casting from a well that can be remotely implemented.

The present embodiments meet these needs.

BRIEF DESCRIPTION OF THE DRAWINGS

The detailed description will be better understood in conjunction with the accompanying drawings as follows.

Figure 1:
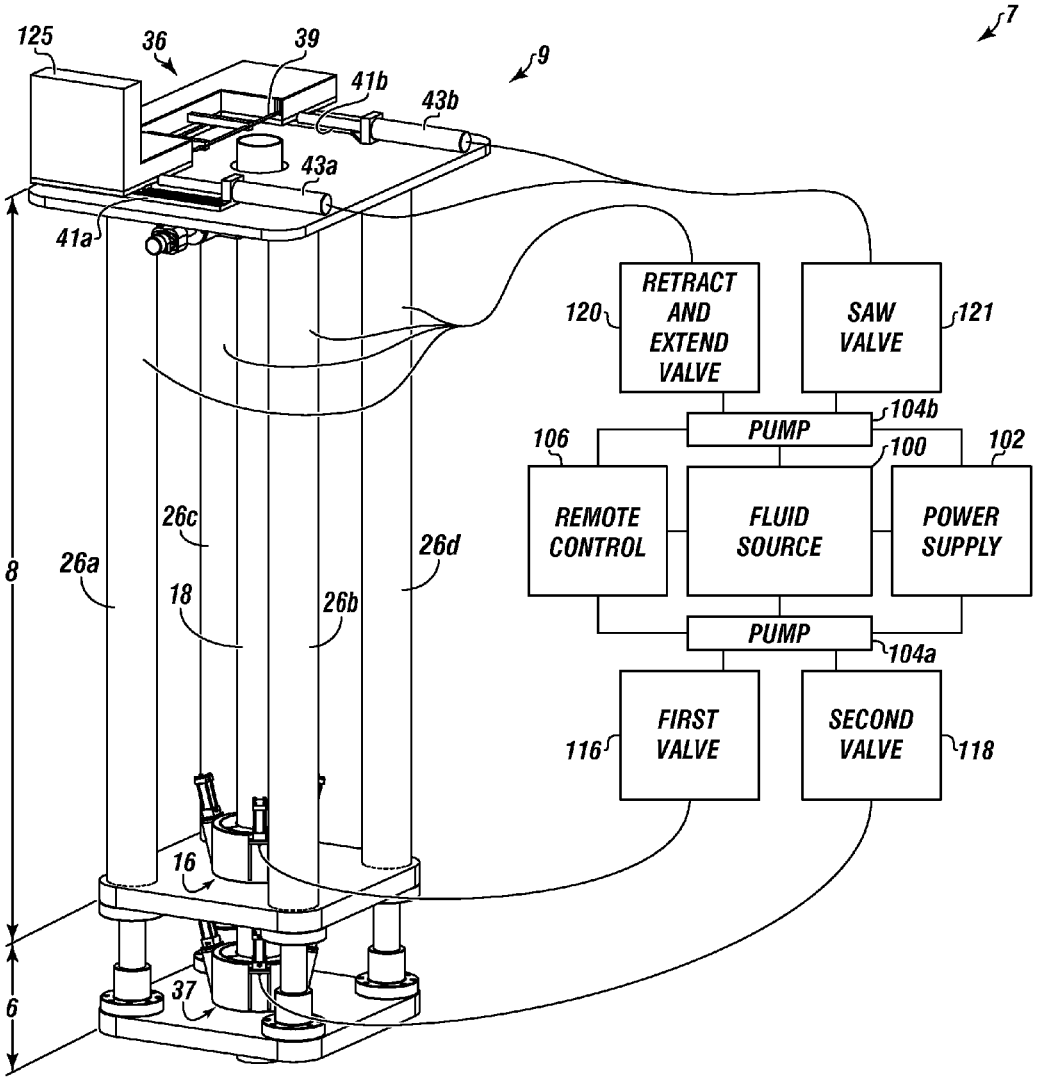
FIG. 1 depicts a perspective view of an embodiment of a tubular lift safety system.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The present embodiments relate to a method for removing tubulars from wellbores, such as oil wells, gas wells, water wells, or the like.

For example, the tubulars can be well casing, well tubing, coiled tubing, or combinations thereof. In one or more embodiments, the tubulars can have cement adhered thereto.

One or more embodiments of the method can be implemented using a wellbore tubular removal system can be configured to lift at least one million pounds per lift.

The wellbore tubular removal system can include a lower section. The lower section can have a lower base plate with a lower base plate hole.

The lower base plate can be made of steel plate. The lower base plate can have a length ranging from about 48 inches to about 96 inches, a width ranging from about 48 inches to about 96 inches, and a thickness ranging from about 4 inches to about 8 inches.

The lower base plate hole can be centered in the lower base plate, and can have a diameter ranging from about 8 inches to about 30 inches.

The lower section can include a plurality of sliding rods, which can be connected with the lower base plate. For example, the sliding rods can be connected with the base plate via rod base flanges.

The sliding rods can be made of steel. The sliding rods can have a length ranging from about 4 feet to about 20 feet and a diameter ranging from about 4 inches to about 12 inches.

The lower section can include a lower gripping member, which can be mounted to the lower base plate. For example, the lower gripping member can be mounted to the lower base plate via bolts.

The lower gripping member can be configured to grip a tubular when the tubular is extended through the lower base plate hole.

The wellbore tubular removal system can include an upper section. The upper section can include an upper base plate with an upper base plate hole.

The upper base plate can be made of steel plate. The upper base plate can have a length ranging from about 48 inches to about 96 inches, a width ranging from about 48 inches to about 96 inches, and a thickness ranging from about 4 inches to about 8 inches.

The upper base plate hole can be centered in the upper base plate, and can have a diameter ranging from about 8 inches to about 30 inches.

The upper section can include a saw mounting plate with a saw mounting plate hole.

The saw mounting plate can be made of steel plate. The saw mounting plate can have a length ranging from about 48 inches to about 96 inches, a width ranging from about 48 inches to about 96 inches, and a thickness ranging from about 4 inches to about 8 inches.

The saw mounting plate hole can be centered in the saw mounting plate, and can have a diameter ranging from about 8 inches to about 30 inches.

The upper section can include an upper gripping member, which can be connected with the upper base plate.

The upper gripping member can be configured to grip the tubular when the tubular is extended through the upper base plate hole. The tubular can be disposed at least partially above the wellbore and at least partially in the wellbore.

The upper section can include a plurality of cylinder barrels, which can be connected with the upper base plate at a first end and with the saw mounting plate at a second end. For example, the cylinder barrels can be connected with the upper base plate and the saw mounting plate via bolting.

The cylinder barrels can be made of steel. The cylinder barrels can have a length ranging from about 4 feet to about 20 feet and a diameter ranging from about 6 inches to about 16 inches. The cylinder barrels can be hollow and have an internal diameter ranging from about 4 inches to about 12 inches.

Each cylinder barrel can be movably engaged about one of the sliding rods, such that the sliding rods can be disposed within hollow portions of the cylinder barrels.

The upper section can include a plurality of pistons. Each piston can be engaged with one of the sliding rods, such as at an end of the sliding rods.

Each cylinder barrel can be movably engaged about one of the pistons, such that the pistons can be disposed within the hollow portions of the cylinder barrels. The pistons can be made of steel.

The upper section can include a plurality of piston caps. Each piston cap can be connected to an end of one of the cylinder barrels, and can be disposed between one of the pistons and the saw mounting plate. The piston caps can be made of steel.

In operation, the cylinder barrels can be configured to be moved relative to the pistons and the sliding rods for extending and retracting the upper section from the lower section. For example, a force or air can be applied or increased to the pistons and the piston caps by flowing a hydraulic fluid or air into the hollow portions of the cylinder barrels to extend the upper section relative to the lower section, and the force on the pistons and the piston caps can be removed or decreased by flowing the hydraulic fluid or air out of the hollow portions of the cylinder barrels to retract the upper section relative to the lower section.

The upper section can include one or more cutting devices, which can be connected to the saw mounting plate, such as via bolting. Each cutting device can be disposed between the saw mounting plate and the upper base plate. Each cutting device can have a cutting member, which can be configured to form at least one lifting hole into the tubular.

The upper section can include a saw, which can be mounted to the saw mounting plate opposite the one or more cutting devices, such as via bolting.

In operation, the wellbore tubular removal system can be configured to be concentrically positioned over the wellbore in a retracted position to align the upper base plate hole, the lower base plate hole, and the saw mounting plate hole with the tubular.

The wellbore tubular removal system can be configured to lift the tubular out of the wellbore by sequentially gripping the tubular using the upper gripping member and the lower gripping member, and extending and retracting the upper section relative to the lower section to raise the tubular to a predetermined distance from the wellbore through the upper base plate hole, the lower base plate hole, and the saw mounting plate hole.

The wellbore tubular removal system can be configured to install a lifting member in the at least one lifting hole on the tubular. For example, the lifting member can be manually installed into the lifting hole.

The wellbore tubular removal system can be configured to saw the tubular into a cut tubular using the saw.

The wellbore tubular removal system can be configured to allow the cut tubular to be lifted via a hoist.

In operation, the method can include energizing the upper gripping member to grip the tubular, and extending the upper section from the lower section to raise the tubular from the wellbore to a first distance from the wellbore.

The method can include energizing the lower gripping member to grip the tubular, releasing the upper gripping member from the tubular, and retracting the upper section towards the lower section.

The method can include engaging the upper gripping member with the tubular, releasing the lower gripping member from the tubular, and extending the upper section away from the lower section to raise the tubular from the wellbore to a second distance from the wellbore.

The method can include forming at least one lifting hole in the tubular.

The method can include engaging the lower gripping member with the tubular, releasing the upper gripping member from the tubular, and extending the upper section away from the lower section to raise the tubular from the wellbore to a third distance from the wellbore after the at least one lifting hole is formed in the tubular.

The method can include installing the lifting member in each lifting hole, connecting the lifting member with the hoist, cutting the tubular using the saw and removing the cut tubular from the wellbore using the hoist.

The method can include retracting the upper section relative to the lower section.

Turning now to the Figures, FIG. 1 depicts an embodiment of a tubular lift safety system 7 that the wellbore tubular removal system 9 can be incorporated into for implementing one or more embodiments of the method.

The tubular lift safety system 7 can include a fluid source 100 in fluid communication with the cylinder barrels 26*a*, 26*b*, 26*c*, and 26*d* for extending and retracting the upper section 8 relative to the lower section 6. For example, the fluid source 100 can be a hydraulic fluid source or a pneumatic fluid source.

The fluid source 100 can be in fluid communication with the upper gripping member 16 and the lower gripping member 37 for gripping and releasing tubulars, such as the tubular 18.

The fluid source 100 can be in fluid communication with the saw 36 for cutting the tubular 18. The saw 36 can have a saw motor 125 and a blade 39. The saw motor 125 can be hydraulic or pneumatic.

The saw 36 can be mounted on tracks 41*a* and 41*b*. In operation, the fluid source 100 can flow hydraulic fluid or air into saw hydraulic or pneumatic cylinders 43*a* and 43*b* to move the saw 36 along the tracks 41*a*-41*b*; thereby engaging the blade 39 with the tubular 18 for cutting the tubular 18.

The tubular lift safety system 7 can include a power supply 102, such as a generator, in communication with the fluid source 100.

The tubular lift safety system 7 can include one or more pumps 104*a* and 104*b* connected with the power supply 102 and in fluid communication with the fluid source 100 for pumping hydraulic fluid or air therefrom.

The tubular lift safety system 7 can include a remote control 106 in communication with the fluid source 100 and the pumps 104*a*-104*b* for remotely controlling the tubular lift safety system 7.

The tubular lift safety system 7 can include a first valve 116 for hydraulically or pneumatically engaging and releasing the upper gripping member 16, a second valve 118 for hydraulically or pneumatically engaging and releasing the lower gripping member 37, a retract and extend valve 120 for controlling movement of the upper section 8 relative to the lower section 6, and a saw valve 121 for controlling the saw 36.

Figure 2:
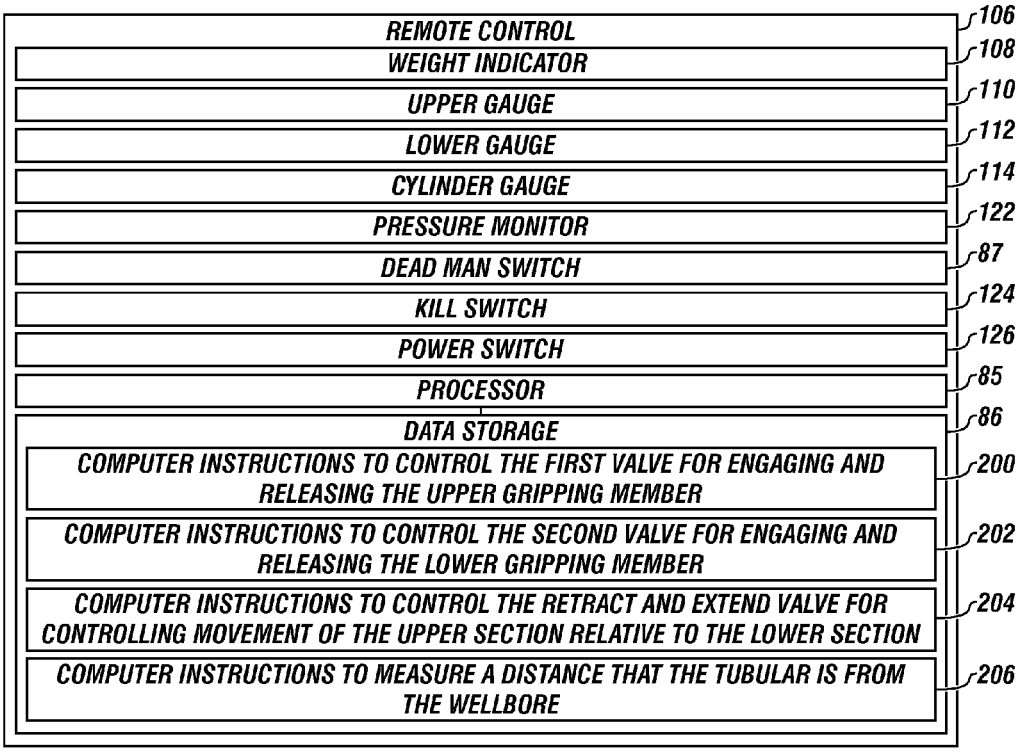
FIG. 2 depicts a detail view of a remote control of the tubular lift safety system.

FIG. 2 depicts a detail of the remote control 106, which can be disposed remote from the wellbore tubular removal system; thereby allowing for safe operation of the wellbore tubular removal system from a distance.

The remote control 106 can include a weight indicator 108 for displaying a weight being lifted by the wellbore tubular removal system.

The remote control 106 can include an upper gauge 110 for displaying a hydraulic or pneumatic pressure on the upper gripping member.

The remote control 106 can include a lower gauge 112 for displaying a hydraulic or pneumatic pressure on the lower gripping member.

The remote control 106 can include a cylinder gauge 114 for displaying a hydraulic or pneumatic pressure on the cylinder barrels.

The remote control 106 can include a pressure monitor 122 for monitoring hydraulic or pneumatic pressure on the saw. The pressure monitor 122 can be configured to turn the saw off when the pressure exceeds a preset limit.

The remote control 106 can include a dead man switch 87 configured to energize the upper gripping member, the lower gripping member, or both, such as when the lower gripping member or the upper gripping member fails or when the hoist releases. For example, the dead man switch 87 can be manually engaged by an operator.

The remote control 106 can include a kill switch 124 configured to terminate flow of the hydraulic fluid or air to the saw and the saw motor.

The remote control 106 can include a power switch 126 for controlling power flowing to the cutting member.

The remote control 106 can include a processor 85 in communication with a data storage 86.

The data storage 86 can include computer instructions to control the first valve for engaging and releasing the upper gripping member 200.

The data storage 86 can include computer instructions to control the second valve for engaging and releasing the lower gripping member 202.

The data storage 86 can include computer instructions to control the retract and extend valve for controlling movement of the upper section relative to the lower section 204.

The data storage 86 can include computer instructions to measure a distance that the tubular is from the wellbore 206.

Figure 3A:
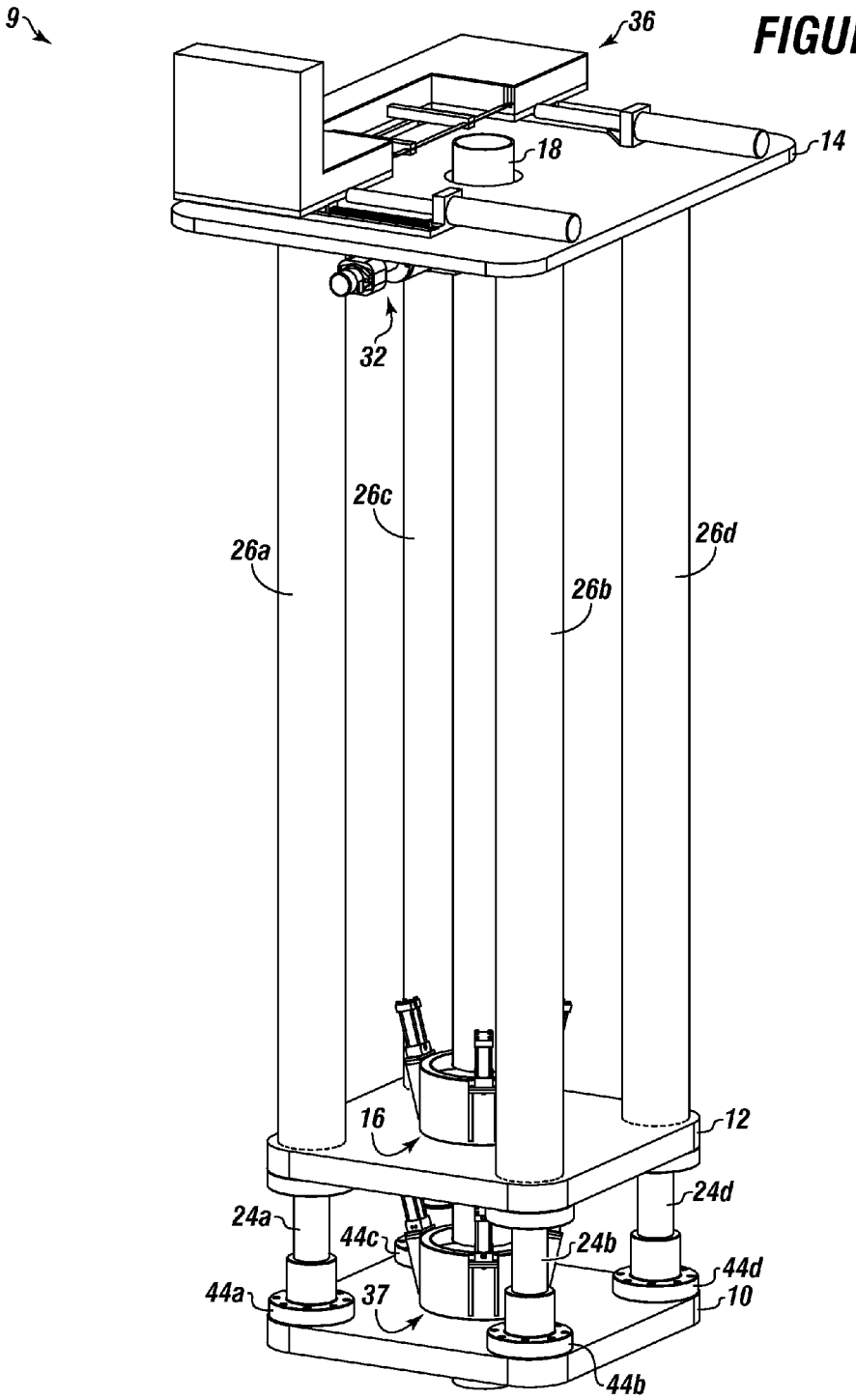
FIG. 3A depicts a perspective view of an embodiment of the wellbore tubular removal system in a retracted position.
Figure 3B:
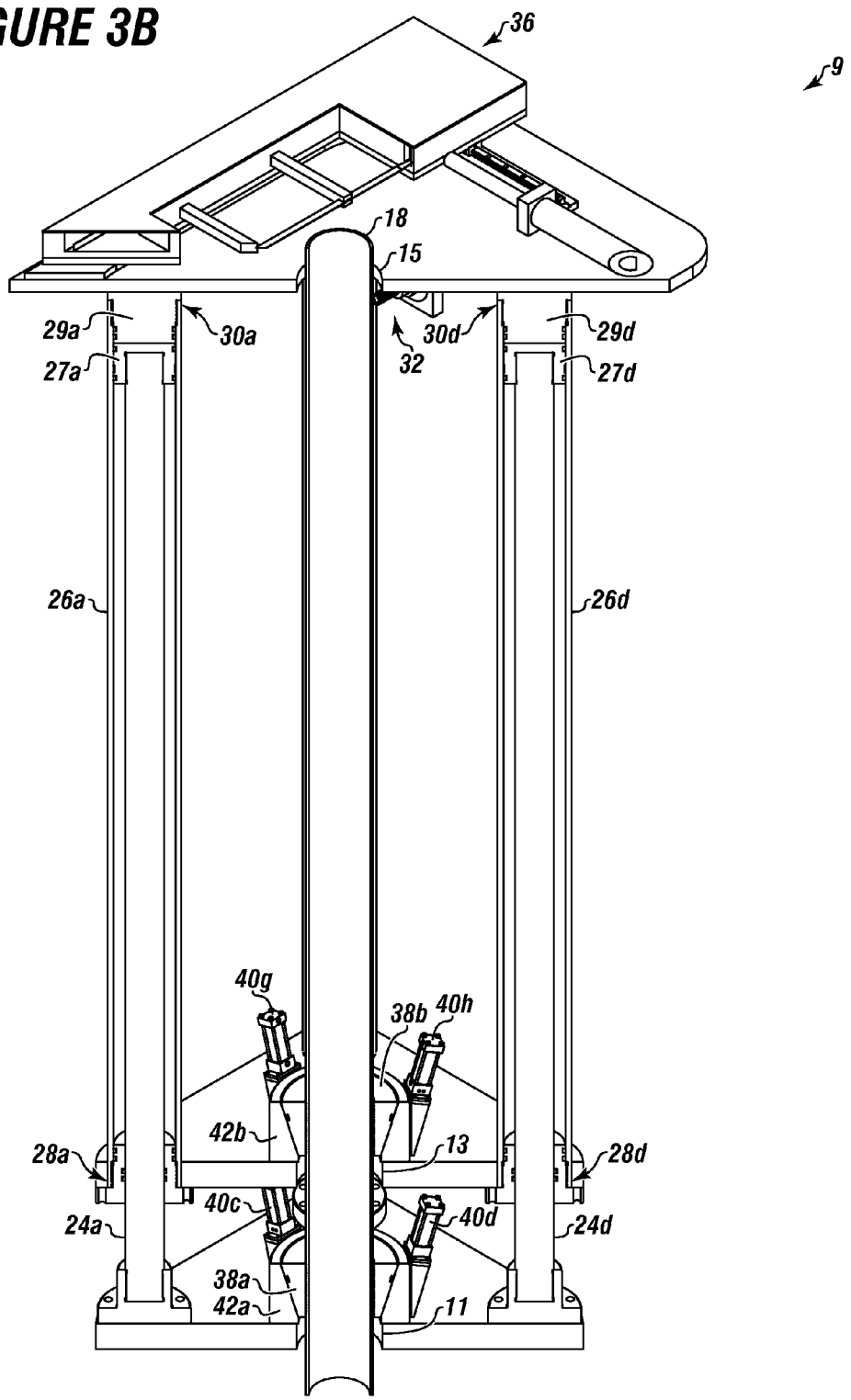
FIG. 3B depicts a cut perspective view of an embodiment of the wellbore tubular removal system in the retracted position.

FIG. 3A depicts a perspective view of an embodiment of the wellbore tubular removal system 9 in a retracted position, and FIG. 3B depicts a cut perspective view of the wellbore tubular removal system 9 in the retracted position.

The lower section of the wellbore tubular removal system 9 can include a lower base plate 10. A lower base plate hole 11 can be disposed through the lower base plate 10.

The lower section of the wellbore tubular removal system 9 can include a plurality of sliding rods, including sliding rods 24*a*, 24*b*, and 24*d*, connected with the lower base plate 10. For example, the sliding rods 24*a*, 24*b*, and 24*d* can be connected with the lower base plate 10 via rod base flanges 44*a* and 44*d*.

The lower section of the wellbore tubular removal system 9 can include the lower gripping member 37, which can be mounted to the lower base plate 10.

The lower gripping member 37 can be configured to grip tubulars, such as the tubular 18 when the tubular 18 is extending through the lower base plate hole 11.

The upper section of the wellbore tubular removal system 9 can include an upper base plate 12. An upper base plate hole 13 can be disposed through the upper base plate 12.

The upper section of the wellbore tubular removal system 9 can include a saw mounting plate 14. A saw mounting plate hole 15 can be disposed through the saw mounting plate 14.

The upper section of the wellbore tubular removal system 9 can include the upper gripping member 16 connected with the upper base plate 12. The upper gripping member 16 can be configured to grip the tubular 18 when the tubular 18 is extending through the upper base plate hole 13.

In one or more embodiments, the upper gripping member 16 and the lower gripping member 37 can each include a slip set, such as slip sets 38*a* and 38*b*, and a plurality of slip set cylinders, such as slip set cylinders 40*c*, 40*d*, 40*g*, and 40*h*. Each slip set cylinder 40*c*, 40*d*, 40*g*, and 40*h* can be disposed around one of the slip sets 38*a*-38*b*, and can be supported by slip bowls, such as slip bowls 42*a* and 42*b*.

The upper section of the wellbore tubular removal system 9 can include the plurality of cylinder barrels 26*a*, 26*b*, 26*c*, and 26*d* connected with the upper base plate 12 at a first end, such as first ends 28*a* and 28*d*, and connected with the saw mounting plate 14 at a second end, such as second ends 30*a* and 30*d*.

Each cylinder barrel 26*a*-26*d* can be movably engaged with one of the sliding rods. For example, the sliding rod 24*a* can be movably engaged within the cylinder barrel 26*a* and the sliding rod 24*d* can be movably engaged within the cylinder barrel 26*d*.

The upper section of the wellbore tubular removal system 9 can include a plurality of pistons, such as pistons 27*a* and 27*d*. Each piston can be engaged with one of the sliding rods. For example, the piston 27*a* can be engaged with the sliding rod 24*a* and the piston 27*d* can be engaged with the sliding rod 24*d*.

Each cylinder barrel 26*a*-26*d* can be movably engaged with one of the pistons. For example, the piston 27*a* can be engaged within the cylinder barrel 26*a* and the piston 27*d* can be engaged within the cylinder barrel 26*d*.

The upper section of the wellbore tubular removal system 9 can include a plurality of piston caps, such as piston caps 29*a* and 29*d*.

Each piston cap can be connected to an end of one of the cylinder barrels 26*a*-26*d* between one of the pistons and the saw mounting plate 14. For example, the piston cap 29*a* can be connected to an end of the cylinder barrel 26*a* between the piston 27*a* and the saw mounting plate 14, and piston cap 29*d* can be connected to an end of the cylinder barrel 26*d* between the piston 27*d* and the saw mounting plate 14.

The cylinder barrels 26*a*-26*d* can be configured to be moved relative to the pistons and the sliding rods for extending and retracting the upper section from the lower section.

The upper section of the wellbore tubular removal system 9 can include one or more cutting devices 32 connected to the saw mounting plate 14. The one or more cutting devices 32 can be disposed between the saw mounting plate 14 and the upper base plate 12.

The one or more cutting devices 32 can include an abrasive water jet, a laser, a variable speed tungsten carbide saw, or combinations thereof.

The upper section of the wellbore tubular removal system 9 can include the saw 36 mounted to the saw mounting plate 14 opposite the one or more cutting devices 32. In one or more embodiments, the saw 36 can be a band saw, a blade saw, or a hydraulic rotating cutter.

Figure 4:
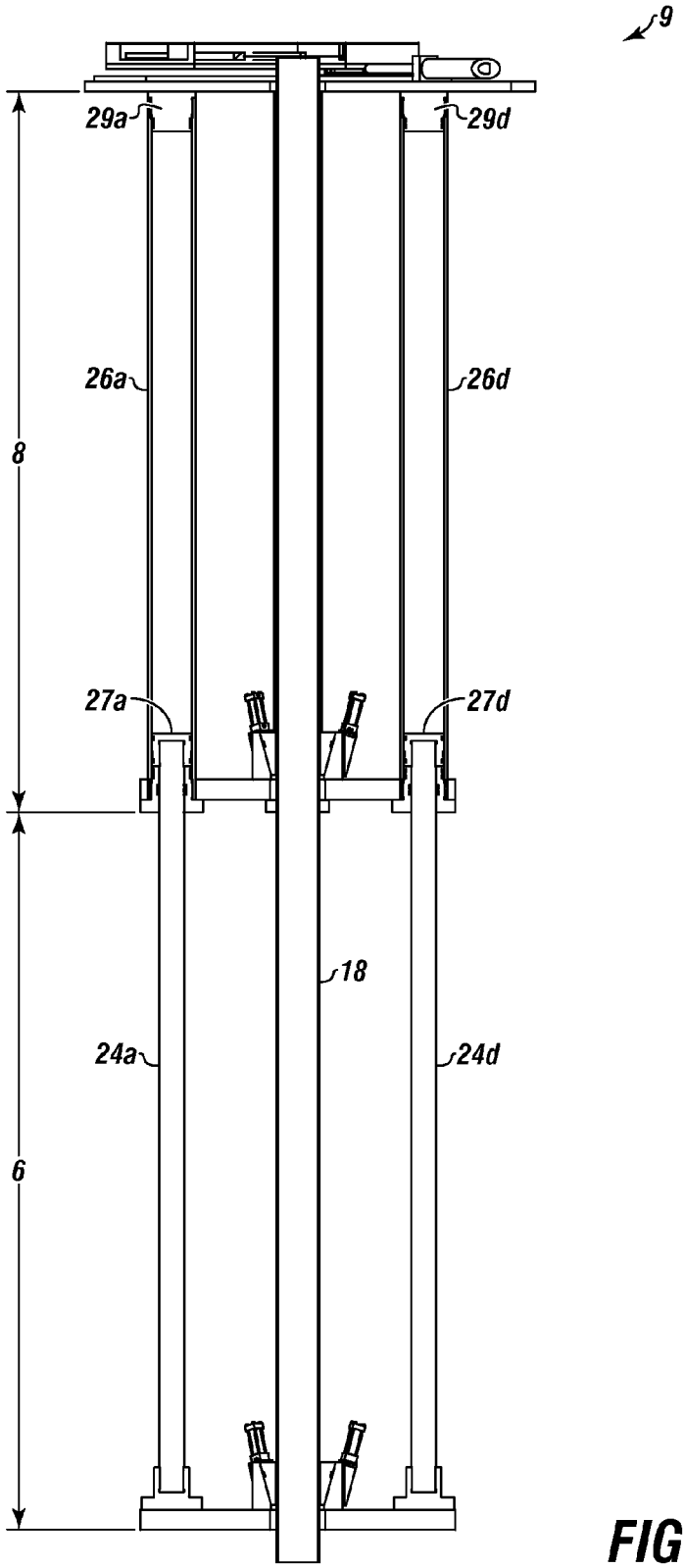
FIG. 4 depicts a cut front view of an embodiment of the wellbore tubular removal system in an extended position.

FIG. 4 depicts a cut front view of an embodiment of the wellbore tubular removal system 9 in an extended position.

The upper section 8 can be extended from the lower section 6 by flowing hydraulic fluid or air from the fluid source into the cylinder barrels, such as the cylinder barrels 26*a* and 26*d*.

The hydraulic fluid or air can apply hydraulic or pneumatic pressure to the pistons, such as the pistons 27*a* and 27*d*, as well as to the piston caps, such as the piston caps 29*a* and 29*d*; thereby extending the cylinder barrels 26*a* and 26*d* from the sliding rods 24*a* and 24*d*.

The upper section 8 can be retracted from the lower section 6 by flowing the hydraulic fluid or air from the cylinder barrels 26*a* and 26*d* into the fluid source.

As such, the hydraulic or pneumatic pressure applied by the hydraulic fluid or air to the pistons 27*a* and 27*d* and the piston caps 29*a* and 29*d* can be reduced; thereby retracting the cylinder barrels 26*a* and 26*d* towards the sliding rods 24*a* and 24*d* and allowing the wellbore tubular removal system 9 to move the tubular 18.

Figure 5A:
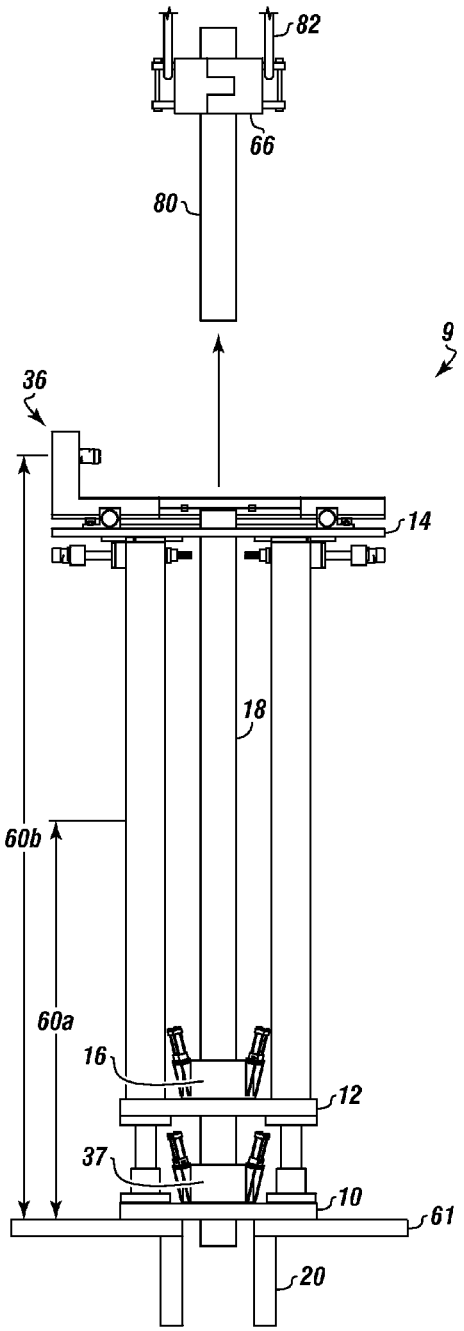
FIG. 5A depicts a front view of an embodiment of the wellbore tubular removal system in the retracted position and engaged with a tubular.
Figure 5B:
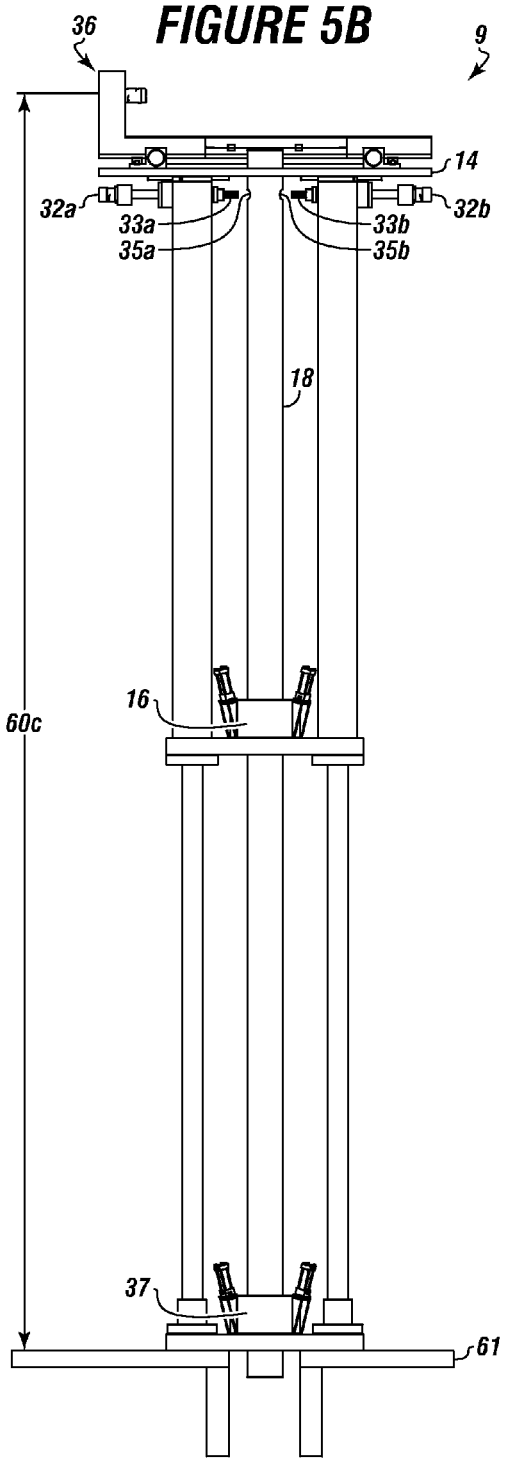
FIG. 5B depicts a front view of an embodiment of the wellbore tubular removal system in the extended position and engaged with the tubular.

FIG. 5A depicts a front view of an embodiment of the wellbore tubular removal system 9 in the retracted position and engaged with the tubular 18, and FIG. 5B depicts a front view of the wellbore tubular removal system 9 in the extended position and engaged with the tubular 18.

The wellbore tubular removal system 9 can be configured to remove the tubular 18 from a wellbore 20. In one or more embodiments, the wellbore tubular removal system 9 can be configured to lift at least one million pounds per lift.

The tubular 18 can be well casing, well tubing, coiled tubing, or combinations thereof.

In operation, the wellbore tubular removal system 9 can be concentrically positioned over the wellbore 20 in the retracted position to align the upper base plate hole of the upper base plate 12, the lower base plate hole of the lower base plate 10, and the saw mounting plate hole of the saw mounting plate 14 with the tubular 18.

The wellbore tubular removal system 9 can lift the tubular 18 out of the wellbore 20 by sequentially gripping the tubular 18 using the upper gripping member 16 and the lower gripping member 37, and extending and retracting the upper section relative to the lower section to raise the tubular 18 to a predetermined distance from the wellbore 20 through the upper base plate hole, the lower base plate hole, and the saw mounting plate hole.

The tubular 18 can be disposed at least partially above the wellbore 20 and at least partially within the wellbore 20. The lower gripping member 37 can grip the tubular 18 when the tubular 18 is extending through the lower base plate hole, and the upper gripping member 16 can grip the tubular 18 when the tubular 18 is extending through the upper base plate hole.

In one or more embodiments, the wellbore tubular removal system 9 can include a first cutting device 32*a* connected to the saw mounting plate 14 and a second cutting device 32*b* connected to the saw mounting plate 14 opposite the first cutting device 32*a*. The first cutting device 32*a* and the second cutting device 32*b* can each be pin drills.

The first cutting device 32*a* can include a first cutting member 33*a* and the second cutting device 32*b* can include a second cutting member 33*b*.

The cutting members 33*a* and 33*b* can include variable sized drill bits having varied diameters and varied drill cutting surfaces for varying a diameter and a type of drill cutting surface according to a diameter and a weight of the tubular 18 being cut.

The variable sized drill bits can include diamond edged drill cutting surfaces, tungsten carbide edged drill cutting surfaces, sand covered drill cutting surfaces, ceramic drill cutting surfaces, or combinations thereof.

In operation, the tubular 18 can be gripped by the upper gripping member 16 and the upper section can be extended from the lower section until the tubular 18 is at a first distance 60*a* from the wellbore 20.

The tubular 18 can then be gripped by the lower gripping member 37, the upper gripping member 16 can release the tubular 18, and the upper section can be retracted towards the lower section.

The upper gripping member 16 can then grip the tubular 18, the lower gripping member 37 can release the tubular 18, and the upper section can be extended from the lower section until the tubular 18 is at a second distance 60*b* from the wellbore 20.

When the tubular 18 has been lifted from the wellbore 20 to the second distance 60*b*, the cutting members 33*a* and 33*b* can form one or more lifting holes 35*a* and 35*b* into the tubular 18.

A lifting member 66 can be installed in the one or more of the lifting holes 35*a* and 35*b*. The lifting member 66 can be a pin, a shackle, a pad eye, a locking dog, a grab bar, or combinations thereof.

The tubular 18 can then be gripped by the lower gripping member 37, the upper gripping member 16 can release the tubular 18, and the upper section can be retracted towards the lower section.

The upper gripping member 16 can then grip the tubular 18, the lower gripping member 37 can release the tubular 18, and the upper section can be extended from the lower section until the tubular 18 is at a third distance 60*c* from the wellbore 20.

When the tubular 18 has been lifted from the wellbore 20 to the third distance 60*c*, the saw 36 can be used to saw the tubular 18 to form a cut tubular 80. The cut tubular 80 can be lifted via a hoist 82.

In one or more embodiments, the lower base plate 10 can engage a device 61 of the wellbore 20. The device 61 can be a blowout preventer, a casing bowl, the ground, a wellhead, a rotary table, support beams, a portion of a rig floor, a portion of a drilling platform, a portion of a production platform, or a portion of a work over platform.

Figure 6A:
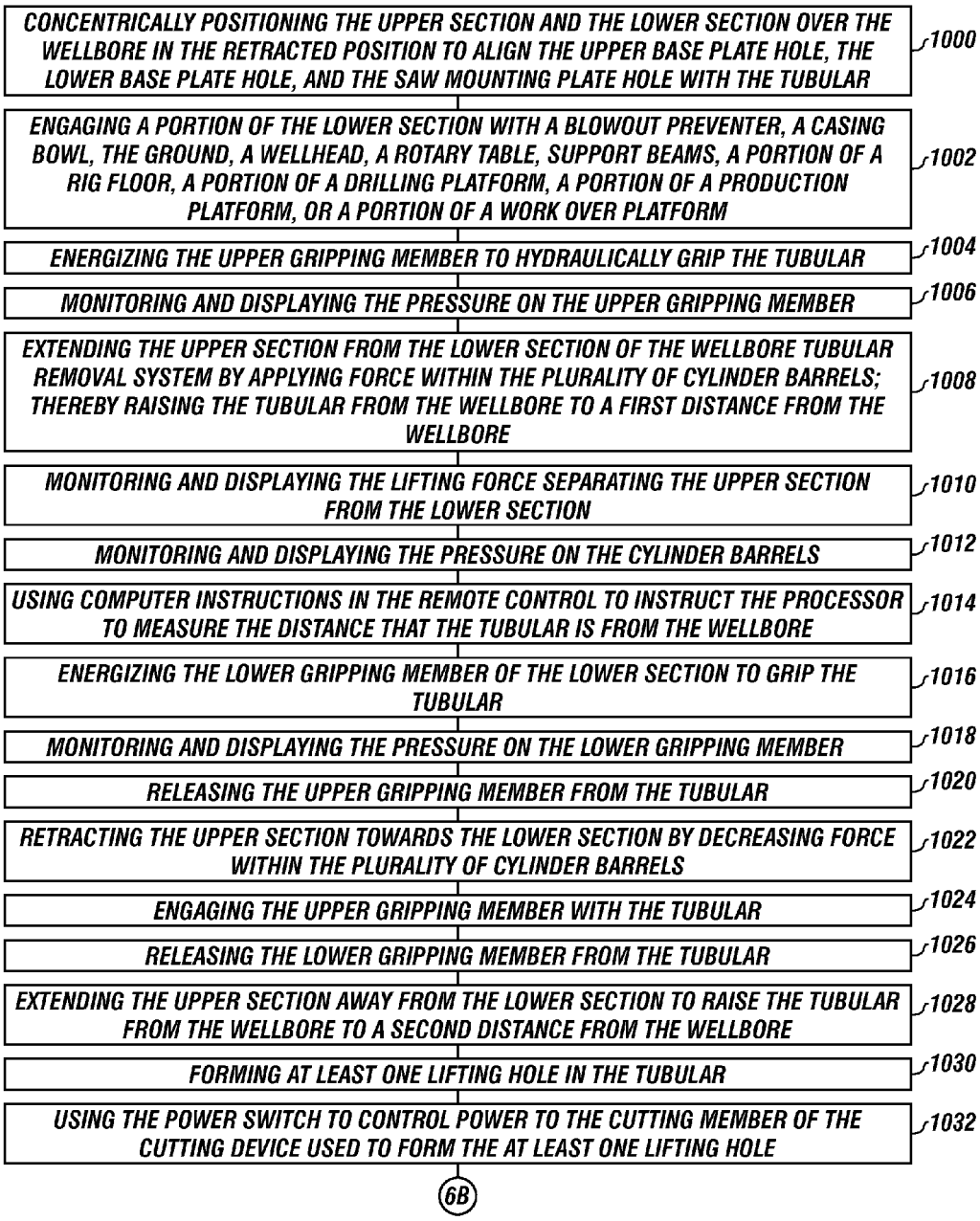
FIGS. 6A-6B depict a diagram of an embodiment of the method for lifting tubular from a wellbore.
Figure 6B:
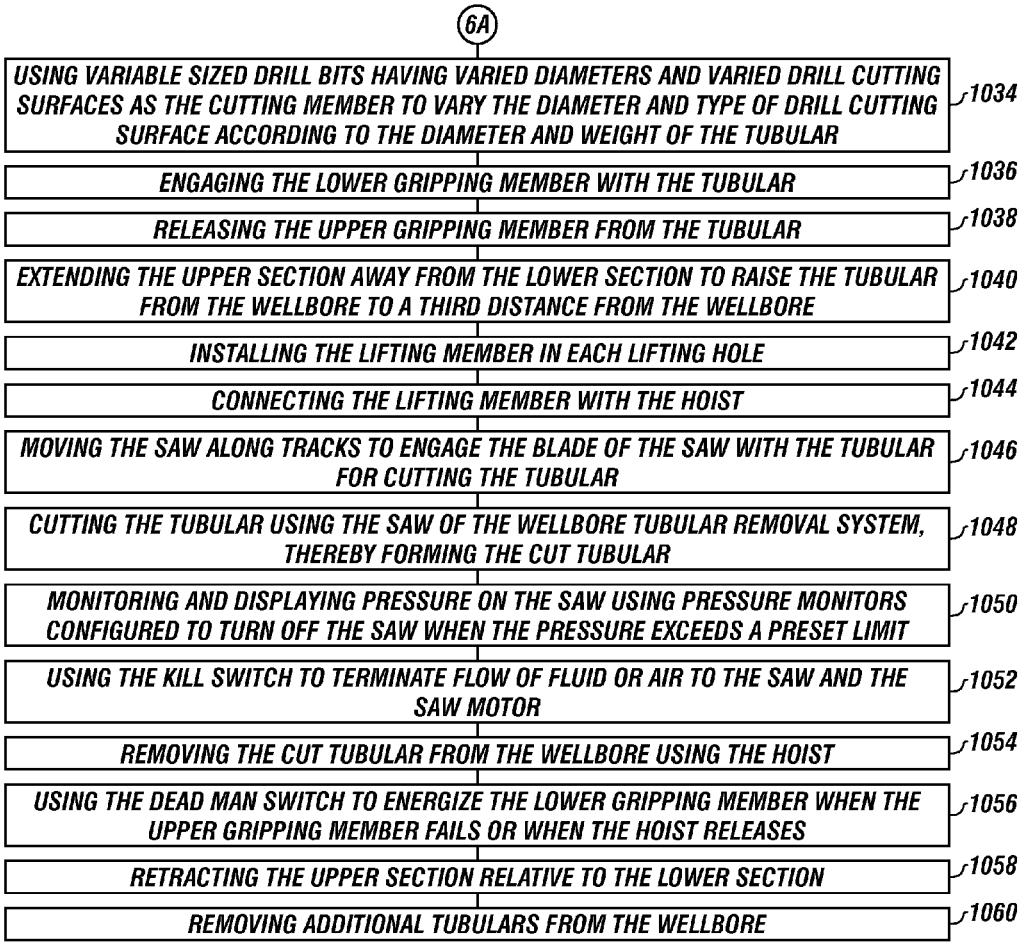

FIGS. 6A-6B depicts a diagram of an embodiment of a method for removing tubulars from wellbores.

The method can include concentrically positioning the upper section and the lower section over the wellbore in the retracted position to align the upper base plate hole, the lower base plate hole, and the saw mounting plate hole with the tubular, as illustrated by box 1000.

The method can include engaging a portion of the lower section with a blowout preventer, a casing bowl, the ground, a wellhead, a rotary table, support beams, a portion of a rig floor, a portion of a drilling platform, a portion of a production platform, or a portion of a work over platform, as illustrated by box 1002.

The method can include energizing the upper gripping member to hydraulically grip the tubular, as illustrated by box 1004. For example, the first valve can be used to engage and release the upper gripping member.

The method can include monitoring and displaying the pressure on the upper gripping member, as illustrated by box 1006.

The method can include extending the upper section from the lower section of the wellbore tubular removal system by applying force within the plurality of cylinder barrels; thereby raising the tubular from the wellbore to a first distance from the wellbore, as illustrated by box 1008. For example, the retract and extend valve can be used to control movement of the upper section relative to the lower section.

The method can include monitoring and displaying the lifting force separating the upper section from the lower section, as illustrated by box 1010. For example, the lifting force can be measured my monitoring the pressure applied by hydraulic fluid or air to extend or retract the upper section.

The method can include monitoring and displaying the pressure on the cylinder barrels, as illustrated by box 1012.

The method can include using computer instructions in the remote control to instruct the processor to measure the distance that the tubular is from the wellbore, as illustrated by box 1014. For example, the distance can be measured in furlongs.

The method can include energizing the lower gripping member of the lower section to grip the tubular, as illustrated by box 1016. For example, the second valve can be used to engage and release the lower gripping member.

The method can include monitoring and displaying the pressure on the lower gripping member, as illustrated by box 1018.

The method can include releasing the upper gripping member from the tubular, as illustrated by box 1020.

The method can include retracting the upper section towards the lower section by decreasing force within the plurality of cylinder barrels, as illustrated by box 1022.

The method can include engaging the upper gripping member with the tubular, as illustrated by box 1024.

The method can include releasing the lower gripping member from the tubular, as illustrated by box 1026.

The method can include extending the upper section away from the lower section to raise the tubular from the wellbore to a second distance from the wellbore, as illustrated by box 1028.

The method can include forming at least one lifting hole in the tubular, as illustrated by box 1030.

The method can include using the power switch to control power to the cutting member of the cutting device used to form the at least one lifting hole, as illustrated by box 1032.

The method can include using variable sized drill bits having varied diameters and varied drill cutting surfaces as the cutting member to vary the diameter and type of drill cutting surface according to the diameter and weight of the tubular, as illustrated by box 1034.

The method can include engaging the lower gripping member with the tubular, as illustrated by box 1036.

The method can include releasing the upper gripping member from the tubular, as illustrated by box 1038.

The method can include extending the upper section away from the lower section to raise the tubular from the wellbore to a third distance from the wellbore, as illustrated by box 1040.

The method can include installing the lifting member in each lifting hole, as illustrated by box 1042.

The method can include connecting the lifting member with the hoist, as illustrated by box 1044.

The method can include moving the saw along tracks to engage the blade of the saw with the tubular for cutting the tubular, as illustrated by box 1046.

The method can include cutting the tubular using the saw of the wellbore tubular removal system, thereby forming the cut tubular, as illustrated by box 1048.

The method can include monitoring and displaying pressure on the saw using pressure monitors configured to turn off the saw when the pressure exceeds a preset limit, as illustrated by box 1050.

The method can include using the kill switch to terminate flow of hydraulic fluid or air to the saw and the saw motor, as illustrated by box 1052.

The method can include removing the cut tubular from the wellbore using the hoist, as illustrated by box 1054.

The method can include using the dead man switch to energize the lower gripping member, the upper gripping member, or combinations thereof when the upper gripping member or the lower gripping member fails or when the hoist releases, as illustrated by box 1056.

The method can include retracting the upper section relative to the lower section, as illustrated by box 1058.

The method can include removing additional tubulars from the wellbore, as illustrated by box 1060.

While these embodiments have been described with emphasis on the embodiments, it should be understood that within the scope of the appended claims, the embodiments might be practiced other than as specifically described herein.

What is claimed is:

1. A method for removing tubulars from wellbores, the method comprising the following steps:

a. energizing an upper gripping member to grip a tubular, wherein the upper gripping member is a portion of an upper section of a wellbore tubular removal system;

b. extending the upper section from a lower section of the wellbore tubular removal system to raise the tubular from the wellbore to a first distance from the wellbore;

c. energizing a lower gripping member of the lower section to grip the tubular;

d. releasing the upper gripping member from the tubular;

e. retracting the upper section towards the lower section;

f. engaging the upper gripping member with the tubular;

g. releasing the lower gripping member from the tubular;

h. extending the upper section away from the lower section to raise the tubular from the wellbore to a second distance from the wellbore;

i. forming at least one lifting hole in the tubular;

j. engaging the lower gripping member with the tubular;

k. releasing the upper gripping member from the tubular;

l. extending the upper section away from the lower section to raise the tubular from the wellbore to a third distance from the wellbore;

m. installing a lifting member in each lifting hole;

n. removing the tubular additional distances from the wellbore using the wellbore tubular removal system;

o. connecting the lifting member with a hoist;

p. cutting the tubular using a saw of the wellbore tubular removal system, thereby forming a cut tubular;

q. removing the cut tubular from the wellbore using the hoist;

r. retracting the upper section relative to the lower section; and s. using a dead man switch to energize the lower gripping member, the upper gripping member, or both the lower gripping member and the upper gripping member when the upper gripping member or the lower gripping member fails or when the hoist releases.

2. The method of claim 1, further comprising repeating steps a through r to remove additional tubulars from the wellbore.

3. The method of claim 1, wherein:

a. the lower section comprises a lower base plate connected with a plurality of sliding rods and a lower base plate hole formed in the lower base plate; and b. the upper section comprises a plurality of cylinder barrels connected with an upper base plate at a first end and with a saw mounting plate at a second end, wherein each cylinder barrel is movably engaged with one of the sliding rods, wherein the upper base plate has an upper base plate hole, and wherein the saw mounting plate has a saw mounting plate hole.

4. The method of claim 3, further comprising concentrically positioning the upper section and the lower section over the wellbore in a retracted position to align the upper base plate hole, the lower base plate hole, and the saw mounting plate hole with the tubular.

5. The method of claim 3, wherein retracting and extending the upper section relative to the lower section comprises applying a hydraulic force or pneumatic force within the plurality of cylinder barrels.

6. The method of claim 3, wherein the saw comprises a saw motor for operating the blade, wherein the saw is mounted on the tracks, wherein the tracks are on the saw mounting plate, and wherein the saw comprises saw hydraulic or pneumatic cylinders for moving the saw on the tracks.

7. The method of claim 1, further comprising using computer instructions in a remote control to instruct a processor to measure a distance that the tubular is from the wellbore.

8. The method of claim 1, further comprising:

a. monitoring and displaying a lifting force separating the upper section from the lower section;

b. monitoring and displaying a pressure on the upper gripping member;

c. monitoring and displaying a pressure on the lower gripping member;

d. monitoring and displaying a pressure on the cylinder barrels;

e. using first valves to engage and release the upper gripping member;

f. using second valves to engage and release the lower gripping member;

g. using retract and extend valves to control movement of the upper section relative to the lower section;

h. monitoring and displaying pressure on the saw using pressure monitors configured to turn off the saw when the pressure exceeds a preset limit;

i. using a kill switch to terminate flow of hydraulic fluid or air to the saw and a saw motor; or j. using a power switch to controlling power to a cutting member of a cutting device used to form the at least one lifting hole.

9. The method of claim 1, wherein the at least one lifting hole is formed using a cutting device having a cutting member on the upper section.

10. The method of claim 9, further comprising using variable sized drill bits having varied diameters and varied drill cutting surfaces as the cutting member to vary a diameter and a type of drill cutting surface according to a diameter and a weight of the tubular.

11. The method of claim 1, further comprising engaging a portion of the lower section with a blowout preventer, a casing bowl, the ground, a wellhead, a rotary table, support beams, a portion of a rig floor, a portion of a drilling platform, a portion of a production platform, or a portion of a work over platform.

12. The method of claim 1, wherein the tubular is well casing, well tubing, a tubular with cement adhered thereto, or coiled tubing.

13. The method of claim 1, further comprising moving the saw along tracks for engaging a blade of the saw with the tubular for cutting the tubular.

14. A method for removing tubulars from wellbores, the method comprising the following steps:

a. energizing an upper gripping member to grip a tubular, wherein the upper gripping member is a portion of an upper section of a wellbore tubular removal system;

b. extending the upper section from a lower section of the wellbore tubular removal system to raise the tubular from the wellbore to a first distance from the wellbore;

c. energizing a lower gripping member of the lower section to grip the tubular;

d. releasing the upper gripping member from the tubular;

e. retracting the upper section towards the lower section;

f. engaging the upper gripping member with the tubular;

g. releasing the lower gripping member from the tubular;

h. extending the upper section away from the lower section to raise the tubular from the wellbore to a second distance from the wellbore;

i. forming at least one lifting hole in the tubular;

j. engaging the lower gripping member with the tubular;

k. releasing the upper gripping member from the tubular;

l. extending the upper section away from the lower section to raise the tubular from the wellbore to a third distance from the wellbore;

m. installing a lifting member in each lifting hole;

n. removing the tubular additional distances from the wellbore using the wellbore tubular removal system;

o. connecting the lifting member with a hoist;

p. cutting the tubular using a saw of the wellbore tubular removal system by moving the saw along tracks for engaging a blade of the saw with the tubular for cutting the tubular, thereby forming a cut tubular;

q. removing the cut tubular from the wellbore using the hoist; and r. retracting the upper section relative to the lower section.

* * * * *